US010818454B2

(12) United States Patent
Park et al.

(10) Patent No.: US 10,818,454 B2
(45) Date of Patent: Oct. 27, 2020

(54) HIGH SPEED SWITCH

(71) Applicant: LSIS CO., LTD., Anyang-si, Gyeonggi-do (KR)

(72) Inventors: Hae-Yong Park, Anyang-si (KR); Jung-Wook Sim, Anyang-si (KR); Gyeong-Ho Lee, Anyang-si (KR)

(73) Assignee: LSIS CO., LTD., Anyang-si, Gyeonggi-Do (KR)

( * ) Notice: Subject to any disclaimer, the term of this patent is extended or adjusted under 35 U.S.C. 154(b) by 0 days.

(21) Appl. No.: 16/498,218

(22) PCT Filed: Aug. 11, 2017

(86) PCT No.: PCT/KR2017/008752
§ 371 (c)(1),
(2) Date: Sep. 26, 2019

(87) PCT Pub. No.: WO2018/182105
PCT Pub. Date: Oct. 4, 2018

(65) Prior Publication Data

US 2020/0075274 A1 Mar. 5, 2020

(30) Foreign Application Priority Data

Mar. 28, 2017 (KR) ..... 10-2017-0039549

(51) Int. Cl.
*H01H 33/38* (2006.01)
*H01H 33/42* (2006.01)
(Continued)

(52) U.S. Cl.
CPC ..... *H01H 33/50* (2013.01); *H01H 33/38* (2013.01); *H01H 33/42* (2013.01); *H01H 33/565* (2013.01)

(58) Field of Classification Search
CPC ..... H01H 33/50; H01H 33/38; H01H 33/42; H01H 33/565; H01H 33/6662;
(Continued)

(56) References Cited

U.S. PATENT DOCUMENTS 2,491,315 A 12/1949 Johnson
5,912,604 A * 6/1999 Harvey ..... H01H 33/6662 218/138
(Continued)

FOREIGN PATENT DOCUMENTS

DE 19716380 C1 10/1998
EP 0924728 A2 6/1999
(Continued)

OTHER PUBLICATIONS

Translation JPS 5034064 (original document published Apr. 12, 1975) (Year: 1975).*
(Continued)

*Primary Examiner* — William A Bolton
(74) *Attorney, Agent, or Firm* — K&L Gates LLP

(57) ABSTRACT

A high speed switch comprises an interrupter unit connected to a main circuit and including a movable electrode and a driving electrode for opening or closing the main circuit; a driving unit including a repulsion coil for providing a driving force for moving the movable electrode of the interrupter unit, and a repulsion plate disposed opposite to the repulsion coil; a guide rod part connecting the movable electrode of the interrupter unit to the repulsion plate, having a latch groove formed therein, and reciprocating vertically according to movements of the repulsion plate; and a state-holding unit for regulating the movement of the guide rod part, wherein the state-holding unit comprises: a latch pin; a latch elastic member; and a latch coil.

13 Claims, 6 Drawing Sheets

(51) Int. Cl.
*H01H 33/50* (2006.01)
*H01H 33/56* (2006.01)

(58) Field of Classification Search
CPC .. H01H 33/6661; H01H 33/143; H01H 33/28; H01H 33/285; H01H 33/60; H01H 33/46; H01H 33/52
USPC ..... 218/146, 120, 121, 140, 153, 154; 335/132
See application file for complete search history.

(56) References Cited

U.S. PATENT DOCUMENTS 6,020,567 A * 2/2000 Ishikawa ..... H01H 3/28 218/120
6,150,909 A * 11/2000 Meier ..... H01H 71/2409 335/129
6,580,345 B2 * 6/2003 Akita ..... H01H 33/285 218/141
6,753,493 B2 * 6/2004 Rhein ..... H01H 33/6662 218/120
8,941,960 B2 * 1/2015 Murray ..... H01H 75/06 361/71
8,963,037 B2 * 2/2015 Nakada ..... H01H 33/42 218/120
9,508,514 B2 * 11/2016 Ohda ..... H01H 33/38
2002/0044036 A1 4/2002 Akita et al.
2012/0274428 A1 * 11/2012 Reuber ..... H01H 33/66207 335/6

FOREIGN PATENT DOCUMENTS

JP S5034064 * 4/1975 ..... H01H 33/42
JP 2001520798 A 10/2001
JP 2002124158 A 4/2002
JP 2003031087 A 1/2003
JP 2003151826 A 5/2003
KR 20120131509 A 12/2012
KR 101266043 B1 5/2013

OTHER PUBLICATIONS

International Search Report for related International Application No. PCT/KR2017/008752; report dated Oct. 4, 2018; (3 pages).
Nritten Opinion for related International Application No. PCT/KR2017/008752; report dated Oct. 4, 2018; (3 pages).
European Search Report for related European Application No. 17903414.5; action dated Mar. 5, 2020; (10 pages).

* cited by examiner

【FIG. 1】
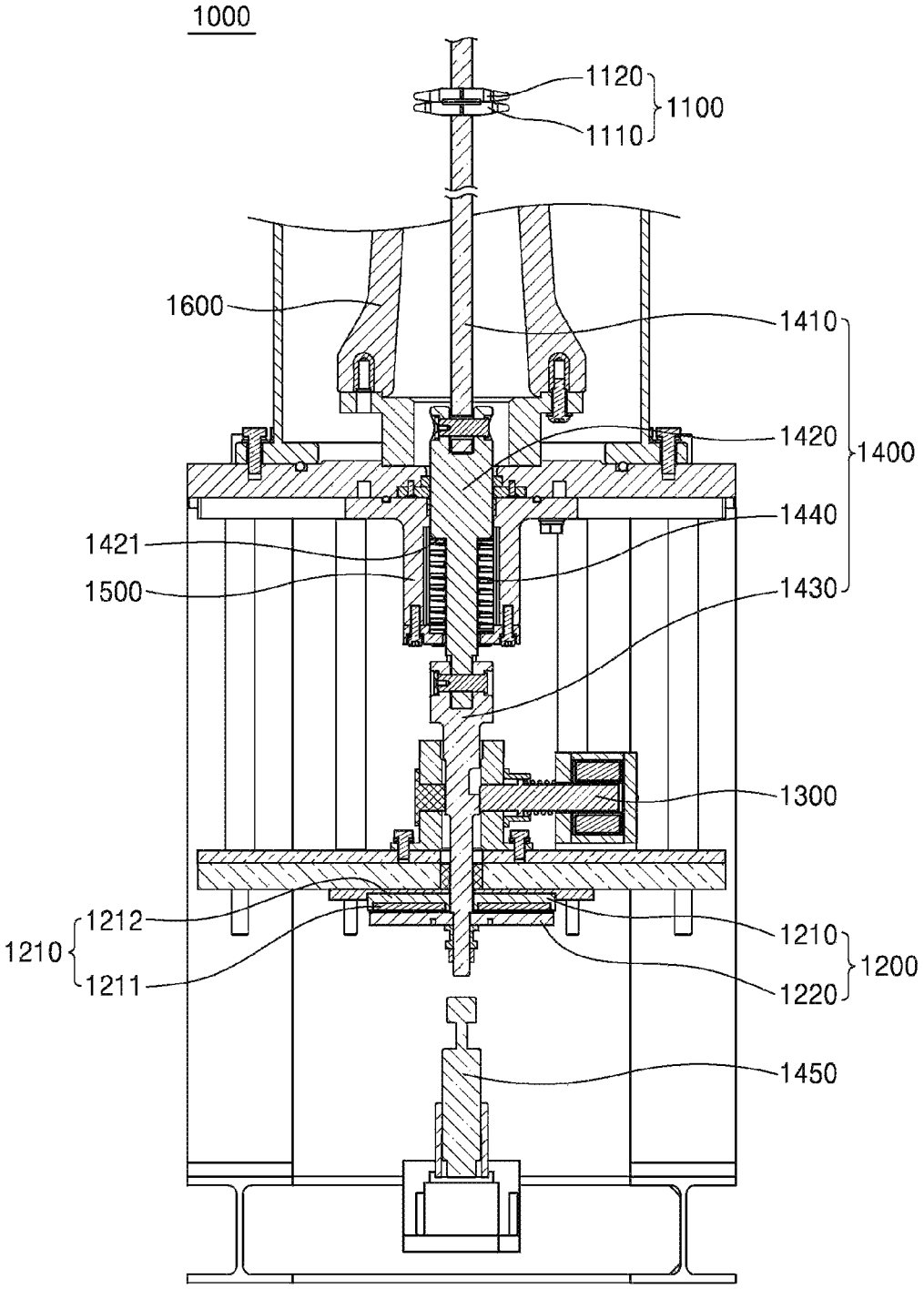

【FIG. 2】
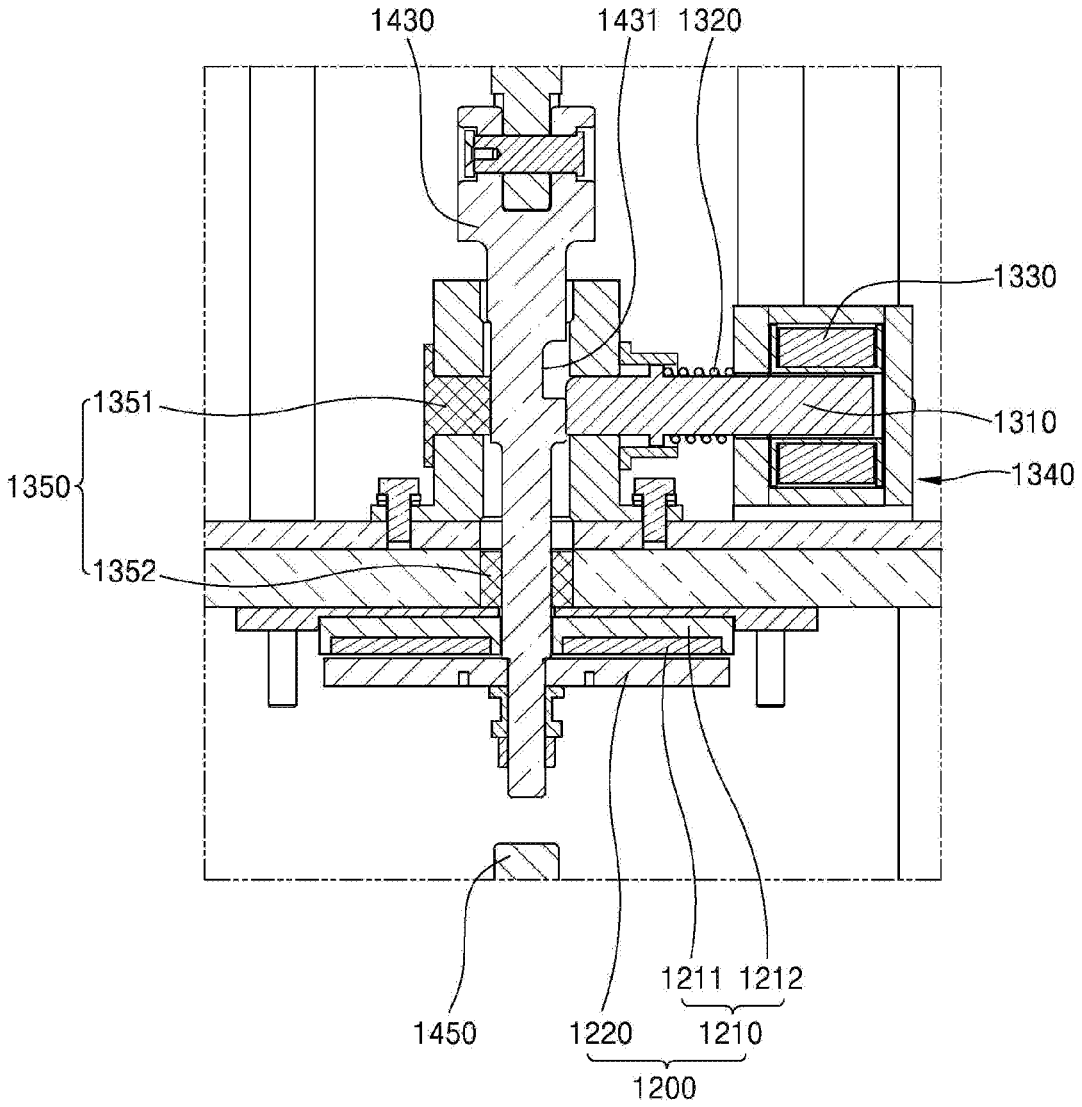

【FIG. 3】
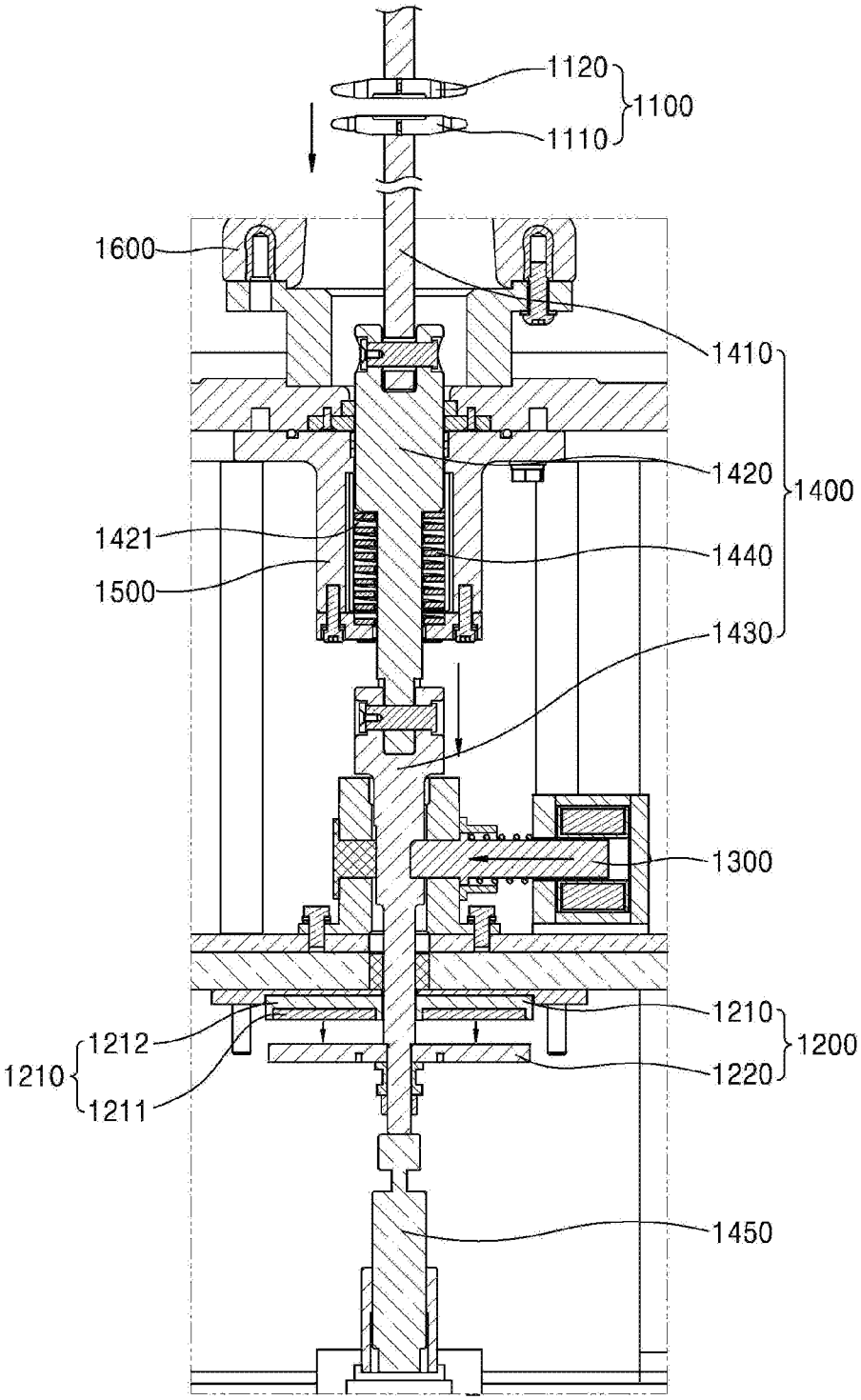

【FIG. 4】
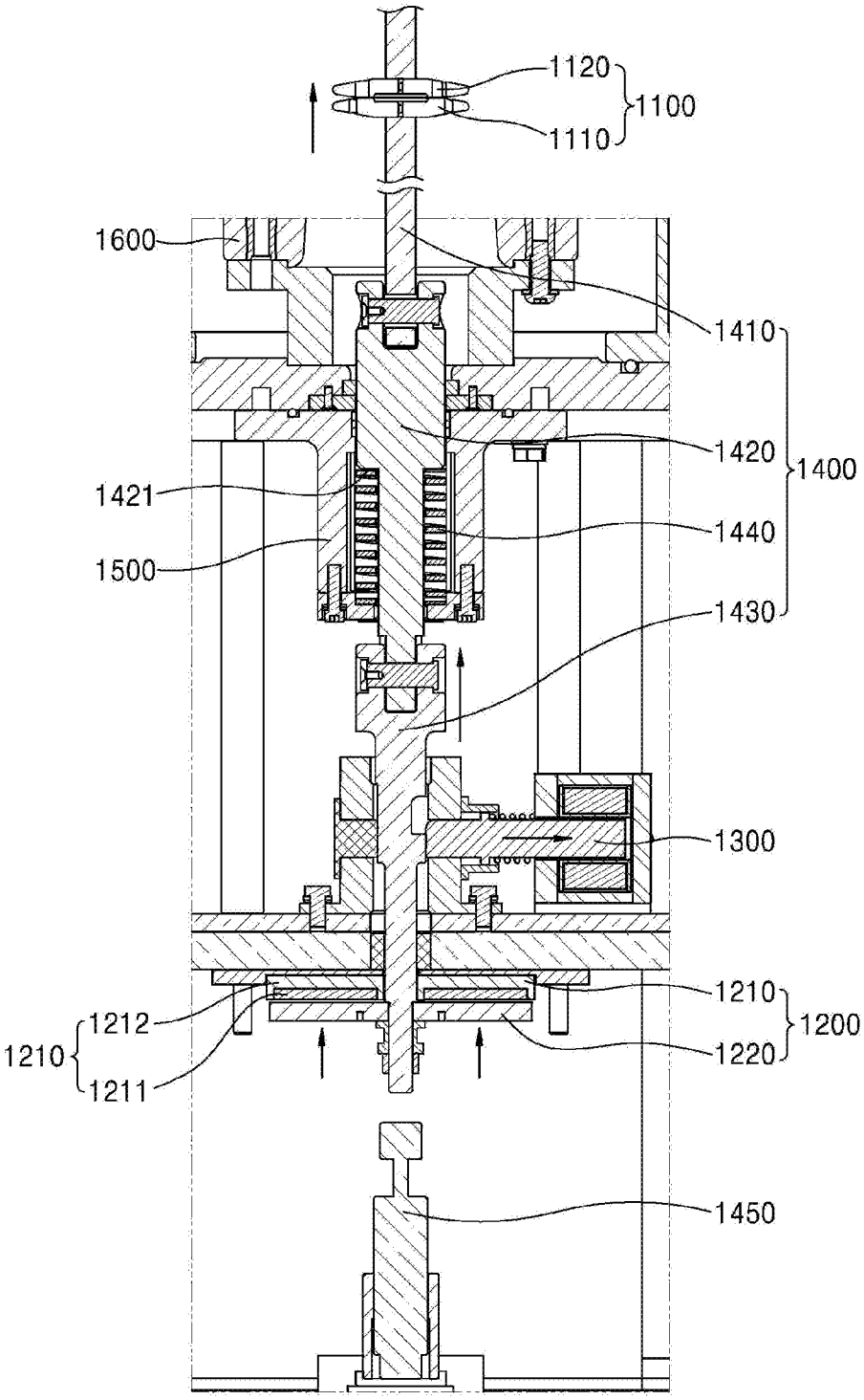

【FIG. 5】
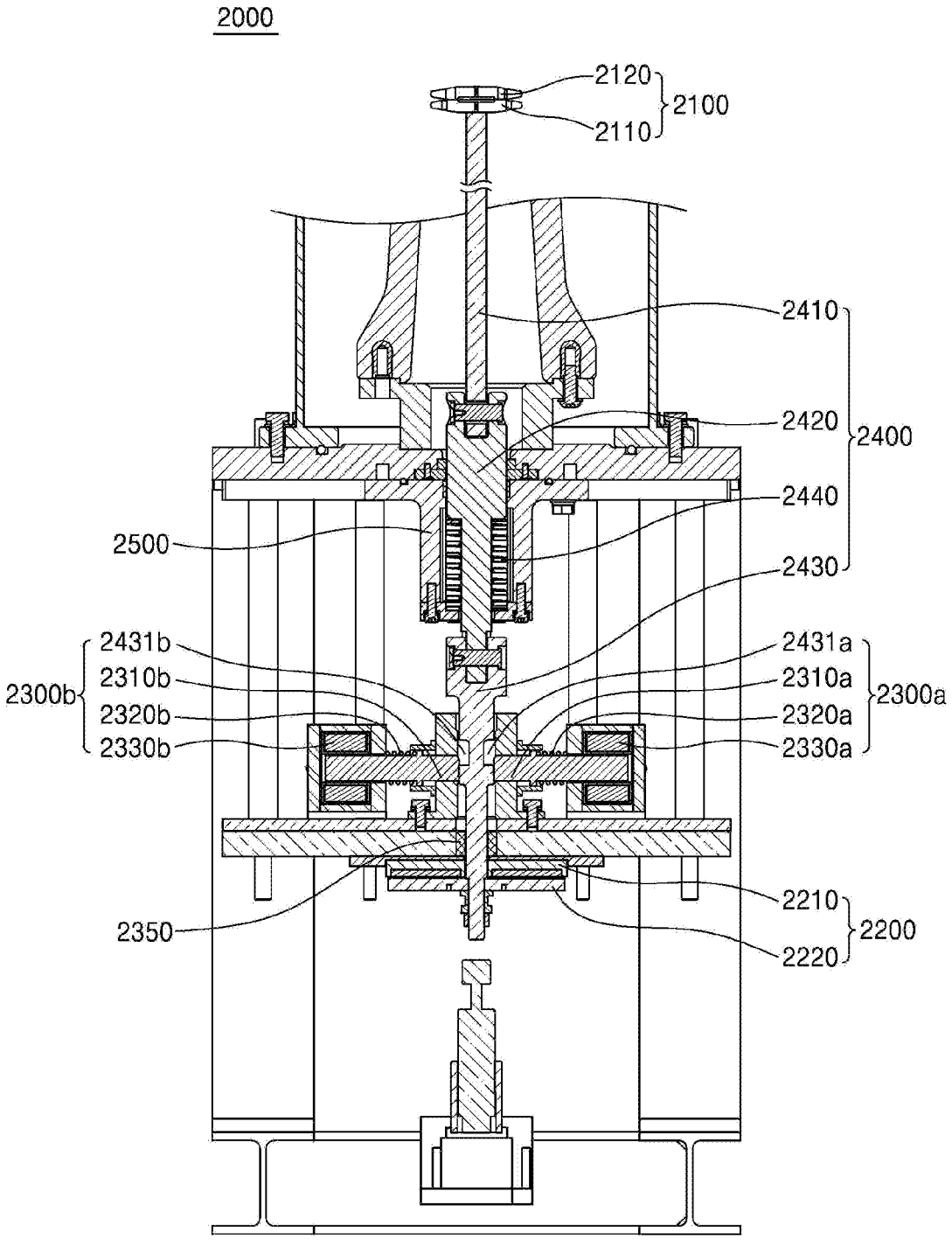

【FIG. 6】
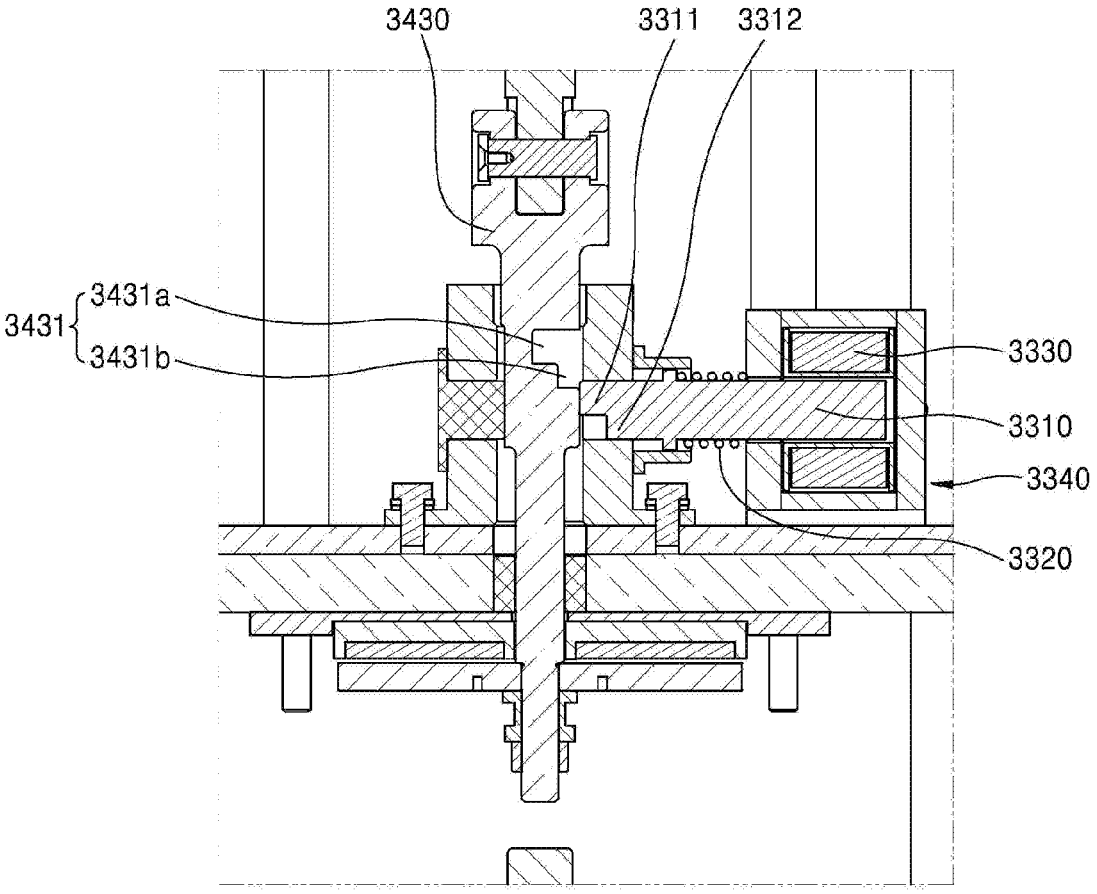

HIGH SPEED SWITCH

CROSS-REFERENCE TO RELATED APPLICATIONS

The present application is a National Stage of International Application No. PCT/KR2017/008752, filed on Aug. 11, 2017, which claims the benefit of earlier filing date and right of priority to Korean Application No. 10-2017-0039549, filed on Mar. 28, 2017, the contents of which are all hereby incorporated by reference herein in their entirety

FIELD OF THE INVENTION

The present disclosure relates to a high-speed switch, and, more specifically, to a high-speed switch having a sealing structure capable of gas insulation, and having increased operating speed and improved reliability against environmental variables by maintaining an open state using a mechanical state-maintaining assembly.

BACKGROUND OF THE INVENTION

In general, a high-speed switch is a power device that can interrupt fault currents such as short-circuit currents at a high speed or to bring a circuit into a closed state by switching into an open or closed state at a high-speed.

The high-speed switch operates at high-speed from milliseconds to tens of milliseconds, thereby to minimize influence of arc generated when the circuit is opened and closed and to quickly break the fault current, thereby reducing the damage of the power device such as a power distribution board.

More specifically, in a conventional power system, a fault current limiter is to operate at a higher speed than a conventional breaker to reduce the fault current to protect the system and devices when the fault current exceeds thermal, electrical, and mechanical durability of the conventional Alternative Current (AC) breakers and power devices.

The DC breaker requires high-speed operation for effective fault current interruption because, due to the characteristic of the fault of the DC power system, the current does not undergo a nature current zero but has steep rise to a maximum fault current based on the power system configuration.

A key requirement of the switch is a high-speed operation to isolate the main circuit contact within a few milliseconds since the power system fails. A operating time duration is defined as a duration from a time point when an operation command signal is received from a fault detect device to a time point when the contact of the switch is separated up to a position where a required insulation distance is secured.

Further, the existing breaker to which a spring mechanism is applied involves removing a latch in advance to open and close the contact after receiving a open or close operation command signal.

In addition, the spring mechanism applied to the breaker according to the related art has a problem that it is fundamentally difficult for the breaker using the spring mechanism to achieve an operating speed required in the fault current limiter and the DC breaker.

Further, a permanent magnet actuator applied to a high-speed switch according to the prior art maintains a close state and a open state of a main circuit contact using a magnetic force of a magnet. Thus, when the opening operation speed is increased, a very large impact amount from a moving portion may occur.

In this connection, there is a problem that a size of the permanent magnet actuator must be very large in order to maintain the open state. Further, as the size increases, a weight of the moving portion increases again. Thus, friction is also increased. When the friction is beyond a certain range, the high-speed operation may not be achieved.

Further, when the breaker operates at a high speed, the breaker may be brought into a re-closed state after the breaking operation due to a large impact amount.

BRIEF SUMMARY OF THE INVENTION

In one aspect of the present disclosure, there is proposed a high-speed switch comprising: current interrupting means connected to a main circuit, wherein the current interrupting means includes a movable electrode and a fixed electrode for opening and closing the main circuit; a driving assembly including: a repulsive coil for providing a driving force to move the movable electrode of the current interrupting means; and a repulsive plate facing the repulsive coil; a guide rod assembly for connecting the movable electrode of the current interrupting means to the repulsive plate, wherein a latch groove is defined in the guide rod assembly, wherein the guide rod assembly reciprocates vertically together with a vertical movement of the repulsive plate; and a state-maintaining assembly configured to control the movement of the guide rod assembly, wherein the state-maintaining assembly includes: a latch pin whose end corresponds to the latch groove; a latch elastic member for pressing the latch pin toward the guide rod assembly such that the end of the latch pin is inserted into the latch groove; and a latch coil wound around an outer circumferential face of the latch pin to provide a driving force for releasing the latch pin from the latch groove.

In one implementation, the state-maintaining assembly further include a latch guide to limit displacement of the guide rod assembly in directions other than the vertical direction of the movement of the guide rod assembly, wherein the latch guide includes at least one of first and second latch guides, wherein the first latch guide disposed opposite to the latch pin around the guide rod assembly, wherein the second latch guide surrounds an outer circumferential face of the guide rod assembly.

In one implementation, the guide rod assembly includes an insulating rod, a seal rod and a latch rod, wherein the insulating rod is connected to the movable electrode, wherein the seal rod has one end connected to the insulating rod and the other end connected to the latch rod, wherein the latch rod has one end connected to the seal rod and the other end coupled to the repulsive plate, wherein the latch groove is defined in the latch rod, wherein the state-maintaining assembly has a vertical level corresponding to a vertical level of the latch rod.

In one implementation, the guide rod assembly further includes a rod elastic member for elastically supporting the seal rod so that the seal rod is pressed toward the fixed electrode, wherein the rod elastic member is contained in a sealing housing.

In one implementation, the guide rod assembly further include a shock absorber configured to mitigate impact resulting from the movement of the repulsive plate, wherein the shock absorber is positioned to face the latch rod while being increasingly away from the repulsive plate as the repulsive plate moves to bring an open state of the switch.

In one implementation, the current interrupting means is embedded in a gas tank having a gas sealed therein.

In one implementation, the state-maintaining assembly further includes a mount structure that supports the latch pin, the latch elastic member, and the latch coil, wherein the mount structure is located outside the gas tank.

In one implementation, the state-maintaining assembly includes a first fixing unit and a second fixing unit opposite to each other around the latch rod, wherein the latch rod has a first latch groove and a second latch groove defined therein, wherein the first fixing unit includes: a first latch pin whose end corresponds to the first latch groove; a first latch elastic member for urging the first latch pin toward the latch rod such that the first latch pin is inserted into the first latch groove; and a first latch coil surrounding the first latch pin to provide a first driving force to separate the first latch pin from the first latch groove, wherein the second fixing unit includes: a second latch pin whose end corresponds to the second latch groove; a second latch elastic member for urging the second latch pin toward the latch rod such that the second latch pin is inserted into the second latch groove; and a second latch coil surrounding the second latch pin to provide a second driving force to separate the second latch pin from the second latch groove.

In one implementation, the end of the latch pin has a first end and a second end, wherein the first end is a distal end extending from the second end, wherein the first end is smaller than the second end, wherein the latch groove defined in the latch rod includes a first groove corresponding to the first end and a second groove corresponding to the second end.

In one implementation, the driving assembly further include a bobbin around which the repulsive coil is wound, wherein one face of the repulsive coil faces the repulsive plate, while an opposite face of the repulsive coil faces the bobbin.

The details of other embodiments are included in the detailed description and drawings.

According to the present disclosure, the high-speed switch may be achieved which has increased operating speed and improved reliability against environmental variables, in which a breaker opens at high speed within a few milliseconds, which is applied to ultra-high voltage lines, and is easily checked and maintained.

It will be appreciated that embodiments of a technical idea of the present disclosure may provide various effects as not specifically mentioned.

BRIEF DESCRIPTION OF THE DRAWINGS

FIG. 1 is a schematic diagram illustrating a high-speed switch according to a first embodiment of the present disclosure.

FIG. 2 is a schematic diagram of a state-maintaining assembly in the high-speed switch shown in FIG. 1.

FIG. 3 is a schematic first operation diagram of the high-speed switch shown in FIG. 1.

FIG. 4 shows a schematic second operation diagram of the high-speed switch shown in FIG. 1.

FIG. 5 is a schematic diagram illustrating a high-speed switch according to a second embodiment of the present disclosure.

FIG. 6 is a schematic diagram illustrating a high-speed switch according to a third embodiment of the present disclosure.

DETAILED DESCRIPTIONS OF THE INVENTION

Advantages and features of the present disclosure and methods of achieving them will become apparent with reference to the embodiments as described in detail below with reference to the accompanying drawings. However, the present disclosure is not limited to the embodiments as described herein, but may be embodied in other forms. Rather, the disclosed embodiments are provided so that the disclosure may be thorough and complete, and that the teachings of the present disclosure may be sufficiently conveyed to those skilled in the art.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises", "comprising", "includes", and "including" when used in this specification, specify the presence of the stated features, integers, operations, elements, and/or components, but do not preclude the presence or addition of one or more other features, integers, operations, elements, components, and/or portions thereof.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, preferred embodiments of the present disclosure will be described in detail with reference to the accompanying drawings.

FIG. 1 is a schematic diagram illustrating a high-speed switch according to a first embodiment of the present disclosure. As shown, the high-speed switch 1000 includes current interrupting means 1100, a driving assembly 1200, a state-maintaining assembly 1300, and a guide rod assembly 1400.

More specifically, the current interrupting means 1100 is connected to the main circuit, and includes a movable electrode 1110 and a fixed electrode 1120 for opening and closing the main circuit. The movable electrode 1110 is connected to a guide rod assembly 1400. As the guide rod assembly 1400 moves, the movable electrode 1110 comes into contact with the fixed electrode 1120 to bring a closed state or is separated from the fixed electrode 1120 to bring an open state.

The current interrupting means 1100 is contained in a gas tank 1600 in which gas is sealed.

Further, the driving assembly 1200 is configured for moving the movable electrode 1110 to provide a driving force to bring an open state. For this purpose, the driving assembly 1200 includes a repulsive coil assembly 1210 and a repulsive plate 1220. The repulsive coil assembly 1210 may include a repulsive coil 1211 and a bobbin 1212 around which the repulsive coil 1211 is wound.

Further, one face of the repulsive coil 1211 faces the repulsive plate, while an opposite face thereof faces the bobbin 1212.

The repulsive plate 1220 is connected to the guide rod assembly 1400, and is positioned to face the repulsive coil assembly 1210. When a current is applied to the repulsive coil assembly 1210, the repulsive plate 1220 moves in a direction away from the repulsive coil assembly 1210.

Further, when the repulsive plate 1220 moves, the guide rod assembly 1400 associated with the repulsive plate 1220 moves. Thus, the movable electrode 1110 connected to the guide rod assembly 1400 moves to be separated from with the fixed electrode 1120.

The state-maintaining assembly 1300 is configured for controlling movement of the guide rod assembly 1400. That is, when the guide rod assembly 1400 moves together with the repulsive plate 1220, the state-maintaining assembly 1300 allows the guide rod assembly 1400 to be kept in a constant state.

The state-maintaining assembly 1300 will be described later in more detail with reference to FIG. 2.

The guide rod assembly 1400 is configured for moving the movable electrode 1110 in a vertical reciprocating motion in conjunction with movement of the repulsive plate 1220.

To this end, the guide rod assembly 1400 includes an insulating rod 1410, a seal rod 1420, and a latch rod 1430. The insulating rod 1410, the seal rod 1420, and the latch rod 1430 are connected to each other in a linear manner. Each of the insulating rod 1410, the seal rod 1420, and the latch rod 1430 has a location specific to a function thereof.

Further, the insulating rod 1410 is connected to the movable electrode 1110, and is contained in the gas tank.

The seal rod 1420 has one end connected to the insulating rod 1410 and the other end connected to the latch rod 1430, and is embedded in the sealing housing 1500.

The latch rod 1430 has one end connected to the seal rod 1420. The repulsive plate 1220 is coupled to the other end of the latch rod.

Further, the guide rod assembly 1400 further includes a rod elastic member 1440 that elastically supports the seal rod 1420 to be pressed toward the fixed electrode. That is, the rod elastic member 1440 is configured to provide an elastic force to maintain the guide rod assembly 1400 in the close state and then to bring the guide rod assembly 1400 back from the open state to the close state. The rod elastic member 1440 is embedded in the sealing housing 1500.

The seal rod 1420 may have a step 1421 such that the seal rod 1420 is supported by the rod elastic member 1440.

Further, the guide rod assembly 1400 may further include a shock absorber 1450 to mitigate impact resulting from the movement of the repulsive plate 1220.

The shock absorber 1450 may be made of an elastic material such as rubber to improve damping performance.

Further, the shock absorber 1450 is positioned to face the latch rod 1430 while being increasingly away from the repulsive plate 1220 as the repulsive plate 1220 moves to bring the open state.

FIG. 2 is a schematic diagram of the state-maintaining assembly in the high-speed switch shown in FIG. 1.

As shown, the state-maintaining assembly 1300 includes a latch pin 1310, a latch elastic member 1320, a latch coil 1330, a mount structure 1340, and a latch guide 1350.

More specifically, the latch pin 1310 faces the latch rod 1430 and the latch pin 1310 is inserted into a latch groove 1431 to stop the movement of the latch rod 1430.

For this purpose, an end of the latch pin 1310 coupled to the latch groove 1431 has a shape conforming to a shape of the latch groove 1431.

Further, the latch elastic member 1320 is configured for pressing the latch pin 1310 toward the latch rod 1430 so that the pin 1301 is inserted into the latch groove 1431. To this end, the latch elastic member 1320 is positioned around a rear portion of the latch pin 1310 toward the latch rod 1430, and elastically supports the latch pin 1310.

The latch coil 1330 serves to provide a driving force for separating the latch pin 1310 from the latch groove 1431 of the latch rod 1430 upon application of a current to the coil 1330. To this end, the latch coil 1330 is wound around an outer periphery of the latch pin 1310 as a movable portion.

Further, the latch guide 1350 limits displacement of the guide rod assembly 1400 in directions other than a movement in the direction of the guide rod assembly 1400 moving at high speed using the driving force of the driving assembly 1200. In other words, the latch guide 1350 prevents the left/right displacement of the guide rod assembly 1400 when the guide rod assembly 1400 performs the vertical reciprocating motion with reference to FIG. 2.

To this end, the latch guide 1350 may optionally include a first latch guide 1351 positioned on an opposite side of the latch rod 1430 to one side thereof pressed by the latch pin 1310, and a second latch guide 1352 surrounding an outer periphery of the latch rod 1430.

Further, a gap may be formed between an inner circumferential face of the second latch guide 1352 and an outer circumferential face of the latch rod 1430. This is because the latch rod 1430 is not rubbed by the second latch guide 1352 during vertical reciprocating movement of the rod 1430 while only the lateral displacement of the rod 1430 is limited.

The latch pin 1310, the latch elastic member 1320, the latch coil 1330, and the latch guide 1350 are supported by the mount structure 1340. The mount structure 1340 is located outside the gas tank 1600.

FIG. 3 shows a schematic first operation of the high-speed switch shown in FIG. 1. As shown, when a short-circuit current occurs, the high-speed switch 1000 is configured such that current flows to the repulsive coil assembly 1210 of the driving assembly 1200. The magnetic induction of the repulsive coil assembly 1210 allows the repulsive plate 1220 to move away from the repulsive coil assembly 1210.

Further, as the repulsive plate 1220 moves, the latch rod 1430 moves together. As the latch rod 1430 moves, the movable electrode 1110 moves to be in non-contact with the fixed electrode 1120. Eventually, the fixed electrode becomes an open state.

Further, when the latch rod 1430 moves, and when the latch groove 1431 and the latch pin 1310 are coaxially positioned to each other, the latch pin 1310 is inserted into the latch groove 1431 by the latch elastic member 1320 urging the latch pin 1310. Thus, the high-speed switch 1000 remains in the open state.

Further, when the repulsive plate 1220 moves, a lower end of the latch rod 1430 is supported by the shock absorber 1450 and is damped.

Further, the rod elastic member 1440 elastically supporting the seal rod 1420 is compressed as the seal rod 1420 moves.

FIG. 4 shows a schematic second operation of the high-speed switch shown in FIG. 1. As shown, the high-speed switch 1000 magnetizes the latch coil 1330 to switch from an open state to a close state. As a result, the latch pin 1310 is moved.

When the latch pin 1310 is disengaged from the latch groove 1431 in accordance with the movement of the latch pin 1310, the latch rod 1430 is moved toward the fixed electrode 1120 due to the restoring force of the rod elastic member 1440.

As the guide rod assembly 1400 moves, the movable electrode 1110 contacts the fixed electrode 1120. The high-speed switch 1000 is brought into the close state.

FIG. 5 is a schematic diagram of a high-speed switch according to a second embodiment of the present disclosure.

As shown, the high-speed switch 2000 differs from the high-speed switch 1000 shown in FIG. 1 only in terms of a configuration of the state-maintaining assembly.

The high-speed switch 2000 includes current interrupting means 2100, a driving assembly 2200, a state-maintaining assembly 2300, and a guide rod assembly 2400.

Further, the current interrupting means 2100 and the driving assembly 2200 are the same as the current interrupting means 1100 and the driving assembly 1200 of the high-speed switch 1000 shown in FIG. 1, respectively. Descriptions of configurations thereof will be omitted. Further, the guide rod assembly 2400 is the same as the guide rod assembly 1400 shown in FIG. 1. Only the latch groove of the latch rod is different between the high-speed switches 1000 and 2000.

More specifically, the state-maintaining assembly 2300 includes a first fixing unit 2300*a* and a second fixing unit 2300*b* as opposed to each other around the latch rod 2430.

Further, the first fixing unit 2300*a* includes a first latch pin 2310*a*, a first latch elastic member 2320*a*, and a second latch coil 2330*a*.

The second fixing unit 2300*b* includes a second latch pin 2310*b*, a second latch elastic member 2320*b*, and a second latch coil 2330*b*.

A first latch groove 2431*a* corresponding to the first latch pin 2310*a* and a second latch groove 2431*b* corresponding to the second latch pin 2310*b* may be defined in the latch rod 2430.

The state-maintaining assembly 2300 may further include a latch guide 2350 that covers an outer periphery of the latch rod 2430.

As noted above, in the high-speed switch 2000 according to the second embodiment of the present disclosure, when the repulsive plate 2220 is moved by the actuation of the repulsive coil assembly 2210, the latch rod 2430 moves together with the repulsive plate 2220. When the first latch pin 2310*a* and the second latch pin 2310*b* are coaxially positioned with the first latch groove 2431*a* and the second latch groove 2431*b*, respectively, the first latch pin 2310*a* and the second latch pin 2310*b* are inserted into the first latch groove 2431*a* and the second latch groove 2431*b* respectively by the first latch elastic member 2320*a* and the second latch elastic member 2320*b* urging the first latch pin 2310*a* and the second latch pin 2310*b* respectively. As a result, the high-speed switch 2000 remains in the open state.

Further, in order for the high-speed switch 2000 to switch from the open state to the close state, the first latch coil 2330*a* and the second latch coil 2330*b* are magnetized, such that the first latch pin 2310*a* and the second latch pin 2310*b* are moved.

As the first latch pin 2310*a* and the second latch pin 2310*b* move, the first latch pin 2310*a* and the second latch pin 2310*b* are separated from the first latch groove 2431*a* and the second latch groove 2431*b*, respectively. Then, the latch rod 2430 is moved toward the fixed electrode 2120 using the restoring force of the rod elastic member 2440.

As the guide rod assembly 2400 moves, the movable electrode 2110 contacts the fixed electrode 2120 such that the high-speed switch 2000 is brought into a close state.

FIG. 6 is a schematic diagram illustrating a high-speed switch according to a third embodiment of the present disclosure.

As shown in the figure, the high-speed switch 3000 is different from the high-speed switch 1000 according to the first embodiment shown in FIG. 1 only in terms of a shape of an end of the latch pin and a shape of the latch groove corresponding to the end of the latch pin.

More specifically, one end of the latch pin 3310 has a first end 3311 and a second end 3312. The first end 3311 is a distal end extending from the second end. The first end 3311 is smaller than the second end 3312. The first end 3311 is formed in a stepped manner from the second end 3312.

A latch groove 3431 of the latch rod 3430 includes a first groove 3431*a* corresponding to the first end 3311 and a second groove 3431*b* corresponding to the second end 3312.

Further, when the latch pin 3310 is inserted into the latch groove 3431, the first end 3321 is inserted into the first groove 3431*a*, while the second end 3312 is inserted into the second groove 3431*b*.

Using this structure, the latch rod 3430 easily moves due to a small friction thereof with the first end 3311 of the latch pin 3310 when the rod 3430 is moving. During the stopping operation, the first end 3321 and the second end 3312 are doubly supported on the first groove 3431*a* and the second groove 3431*b*, thereby enhancing a coupling force therebetween.

Further, the first end 3311 may be larger than the second end 3312 to reduce the friction force and to improve the coupling strength.

While the preferred embodiments of the present disclosure have been described above with reference to the accompanying drawings, those of ordinary skill in the art to which the present disclosure belongs may understand that the present disclosure may be embodied in other specific forms without departing from the spirit or essential characteristics thereof. It is therefore to be understood that one embodiment described above is illustrative in all aspects and not restrictive.

What is claimed is:

1. A high-speed switch comprising:

current interrupting means connected to a main circuit, wherein the current interrupting means includes a movable electrode and a fixed electrode for opening and closing the main circuit;

a driving assembly including: a repulsive coil for providing a driving force to move the movable electrode of the current interrupting means, and a repulsive plate facing the repulsive coil;

a guide rod assembly for connecting the movable electrode of the current interrupting means to the repulsive plate, wherein the guide rod assembly reciprocates vertically together with a vertical movement of the repulsive plate; and a state-maintaining assembly configured to control a movement of the guide rod assembly, wherein a latch groove is defined in the guide rod assembly, wherein the state-maintaining assembly includes:

a latch pin wherein an end of the latch pin corresponds to the latch groove;

a latch elastic member for pressing the latch pin toward the guide rod assembly such that the end of the latch pin is inserted into the latch groove; and a latch coil wound around an outer circumferential face of the latch pin to provide a driving force for releasing the latch pin from the latch groove.

2. The high-speed switch of claim 1, wherein the state-maintaining assembly further includes a latch guide to limit displacement of the guide rod assembly in directions other than a vertical direction of a movement of the guide rod assembly, wherein the latch guide includes at least one of first and second latch guides, wherein the first latch guide is disposed opposite to the latch pin around the guide rod assembly, wherein the second latch guide surrounds an outer circumferential face of the guide rod assembly.

3. The high-speed switch of claim 2, wherein the guide rod assembly includes an insulating rod, a seal rod and a latch rod, wherein the insulating rod is connected to the movable electrode, wherein the seal rod has one end connected to the insulating rod and another end connected to the latch rod, and wherein the latch rod has one end connected to the seal rod and another end coupled to the repulsive plate, wherein the latch groove is defined in the latch rod.

4. The high-speed switch of claim 3, wherein the guide rod assembly further includes a rod elastic member for elastically supporting the seal rod so that the seal rod is pressed toward the fixed electrode, wherein the rod elastic member is contained in a sealing housing.

5. The high-speed switch of claim 3, wherein the guide rod assembly further includes a shock absorber configured to mitigate impact resulting from a movement of the repulsive plate, wherein the shock absorber is positioned to face the latch rod while being increasingly away from the repulsive plate as the repulsive plate moves to bring an open state of the switch.

6. The high-speed switch of claim 5, wherein the driving assembly further includes a bobbin around which the repulsive coil is wound, wherein one face of the repulsive coil faces the repulsive plate, while an opposite face of the repulsive coil faces the bobbin.

7. The high-speed switch of claim 1, wherein the current interrupting means is embedded in a gas tank having a gas sealed therein.

8. The high-speed switch of claim 7, wherein the state-maintaining assembly further includes a mount structure that supports the latch pin, the latch elastic member, and the latch coil, wherein the mount structure is located outside the gas tank.

9. The high-speed switch of claim 3, wherein the state-maintaining assembly includes a first fixing unit and a second fixing unit opposite to each other around the latch rod, wherein the latch rod has a first latch groove and a second latch groove defined therein, wherein the first fixing unit includes:

a first latch pin wherein an end of the first latch pin corresponds to the first latch groove;

a first latch elastic member for urging the first latch pin toward the latch rod such that the first latch pin is inserted into the first latch groove; and a first latch coil surrounding the first latch pin to provide a first driving force to separate the first latch pin from the first latch groove, wherein the second fixing unit includes:

a second latch pin wherein an end of the second latch pin corresponds to the second latch groove;

a second latch elastic member for urging the second latch pin toward the latch rod such that the second latch pin is inserted into the second latch groove; and a second latch coil surrounding the second latch pin to provide a second driving force to separate the second latch pin from the second latch groove.

10. The high-speed switch of claim 3, wherein the end of the latch pin has a first end and a second end, wherein the first end is a distal end extending from the second end, wherein the first end is smaller than the second end, wherein the latch groove defined in the latch rod includes a first groove corresponding to the first end and a second groove corresponding to the second end.

11. A high-speed switch comprising:

current interrupting means connected to a main circuit, wherein the current interrupting means includes a movable electrode and a fixed electrode for opening and closing the main circuit;

a driving assembly including: a repulsive coil for providing a driving force to move the movable electrode of the current interrupting means, and a repulsive plate facing the repulsive coil;

a seal rod connected to the movable electrode and the repulsive plate; and a state-maintaining assembly configured to control a movement of a guide rod assembly, wherein the seal rod is connected to the movable electrode, wherein the seal rod has one end connected to an insulating rod and another end connected to a latch rod, and wherein the latch rod has one end connected to the seal rod and another end coupled to the repulsive plate, wherein a latch groove is defined in the latch rod.

12. The high-speed switch of claim 11, wherein the seal rod is pressed toward the fixed electrode, wherein a rod elastic member is contained in a sealing housing.

13. The high-speed switch of claim 11, wherein the state-maintaining assembly includes a first fixing unit and a second fixing unit opposite to each other around the latch rod, wherein the latch rod has a first latch groove and a second latch groove defined therein, wherein the first fixing unit includes:

a first latch pin wherein an end of the first latch pin corresponds to the first latch groove;

a first latch elastic member for urging the first latch pin toward the latch rod such that the first latch pin is inserted into the first latch groove; and a first latch coil surrounding the first latch pin to provide a first driving force to separate the first latch pin from the first latch groove, wherein the second fixing unit includes:

a second latch pin wherein an end of the second latch pin corresponds to the second latch groove;

a second latch elastic member for urging the second latch pin toward the latch rod such that the second latch pin is inserted into the second latch groove; and a second latch coil surrounding the second latch pin to provide a second driving force to separate the second latch pin from the second latch groove.

* * * * *